United States Patent [19]

Pine

[11] Patent Number: 4,674,794

[45] Date of Patent: Jun. 23, 1987

[54] RESILIENTLY RELEASING OTTOMAN FOR MOTION CHAIR

[75] Inventor: James J. Pine, Tupelo, Miss.

[73] Assignee: Action Industries, Inc., Tupelo, Miss.

[21] Appl. No.: 857,323

[22] Filed: Apr. 30, 1986

[51] Int. Cl.[4] ..... A47C 1/02

[52] U.S. Cl. ..... 297/85; 297/68; 297/89; 297/330

[58] Field of Search ..... 297/85, 89, 69, 71, 297/68, 330

[56] References Cited

U.S. PATENT DOCUMENTS

| | | | |
|---|---|---|---|
| 3,278,224 | 10/1966 | Dlouhy | 297/71 |
| 3,400,975 | 9/1968 | Rogers, Jr. | 297/85 |
| 3,781,060 | 12/1973 | Pentzien | 297/85 |
| 4,570,996 | 2/1986 | Rogers, Jr. | 297/68 X |

*Primary Examiner*—James T. McCall

*Attorney, Agent, or Firm*—Cushman, Darby & Cushman

[57] ABSTRACT

The front end of each side linkage of an ottoman thrusting/retracting pantograph linkage system for a motion chair is provided by a link, pivotally mounted to respective front end links at two vertically spaced sites. For each side, an ottoman mounting bracket is provided, having a generally vertical-plane flange and a transverse flange. The ottoman is secured to the two transverse flanges, and the vertical-plane flange, which extends below the transverse flange, is pivotally secured near its lower end to a corresponding lower end site on the pantograph front end links. The vertical-plane flanges of the ottoman-mounting brackets lie outboard of and in planes parallel to those of the respective front end links. A tension coil spring is provided at each side for tending to keep the ottoman positioned across the front edges of the front end links. But if, while the mechanism is being operated in a closing sense, the upper, rear edge of the ottoman encounters unusual resistance typical of someone or something being in the space through which the ottoman must move to fully retract, the ottoman will tiltingly release, against tensioning of the springs, permitting whatever is lodged, especially if it is animate, the opportunity and facility to escape, whereupon the springs will restore the ottoman to its normal disposition. By preference a stop is provided to limit tilting of the ottoman to about 90 degrees, in order to avoid damage to the springs which could occur were the ottoman to be intentionally tilted by a chair user's feet, e.g. so the user, while having the ottoman extended, could rest his or her feet against what, normally, is the backside of the ottoman.

16 Claims, 3 Drawing Figures

RESILIENTLY RELEASING OTTOMAN FOR MOTION CHAIR

BACKGROUND OF THE INVENTION

In motion chairs which have an operating mechanism which includes side linkages that have respective pantograph (lazy-tong) linkage systems for thrusting and raising an ottoman (sometimes called a legrest or a footrest), when the mechanism is operated in one sense, and for lowering and stowing that ottoman when the mechanism is operated in an opposite sense, it is customary to mount the ottoman (which generally is a frontally upholstered and padded fairly rigid board), by bolting the ottoman directly to links, flanges or brackets which form corresponding forward ends of the respective pantograph linkage systems (including parallelogram linkage extensions which may be provided as parts of such linkage systems).

Recently, with gains in widespread usage of motion chairs and with improvements in reporting of incidents, the manufacturers of motion chairs have become aware of the desirability of further minimising risks due to uninformed, unintended and, particularly, small children's incorrect use of such furniture.

One measure which recently has gained acceptance is the substantial filling of the space between the ottoman and the front of the seat cushion of the chair, by an apron of upholstery material hanging in a catenary between these two places, or by a sub-ottoman (sometimes called a supplemental or secondary ottoman), which is mounted between respective intermediate links of the pantographs of the two side linkages. It is thought that if no space wide enough to permit a child's head to be inserted between the sub-ottoman and both the main ottoman and the front edge of the seat cushion is present, when the ottoman is in its extended condition and when the ottoman is being moved to and from its extended condition, it has become practically unlikely that a child or pet will become entrapped to their detriment, in that space.

In recent months, consumer and retailer interest has been sparked in electrically-operated motion chairs. Although the mechanical designs for such chairs, basically have been available for many years, and heretofore have found a limited market in the manufacture of dentist's chairs, invalid's chairs and the like, for reasons not easily understood, it seems that electrically-operated motion chairs, including recliners and other motion chairs having thrustable/retractile ottomans may be on the verge of widespread and protracted popularity.

Accordingly, it is useful at this stage for a manufacturer of such chairs not simply to retrieve a classical special-purpose electrically-operated chair mechanical design and lightly adapt it for consumer use, nor simply to electrify an existing manually-operated motion chair design, without also reviewing whether the mechanical design for an electrically-operated motion chair can be improved so as to lower the risks of its improper use. It is also appropriate, in such a case, to consider further whether any feature added to an electrically-operated motion chair could prove beneficial if also provided on manually-operated motion chairs, whether in order also to lower risks due to improper use, or to improve versatility of use, or simply to limit the diversity of different mechanisms which a manufacturer must keep in stock in order to make different types of motion chairs.

The present inventor is aware that others faced with the same design challenges, and working at the behest of other motion chair manufacturers or motion chair hardware manufacturers recently have devised ways and means for permitting an ottoman to become detached from the side linkages should a certain amount of resistance be encountered by the ottoman as the ottoman is being retracted towards a fully stowed condition. (Besides addressing the lodging issue, such a feature also addresses the problem, possibly present with poorly designed or manufactured electrically-operated motion chairs, of how to prevent damage to the ottoman if the electric motor that is effecting the closure is not turned-off at the point where full retraction and stowage of the ottoman has been achieved.) However, it appears to the present inventor that complete popping-off of the ottoman under such conditions, e.g. where the ottoman is secured by pop-type fasteners or by Velcro strips, may not always be a fully satisfactory mode of providing the desired functioning. Especially when the ottoman also is attached to the front of the upholstered chair using a drape of upholstery cloth, the unnoticed detachment of the ottoman from its mountings can, in the next operation of the chair, easily lead to ripping of the drape of upholstery cloth. And Velcro strips can become so fouled that they will no longer hold, due to catching dust, carpet fuzz, fabric ravelings and the likes, instead of one another.

The present invention arose in the context of rethinking an electrically-operated motion chair mechanical design, in which the lodging issue is addressed in a manner which seems not only to be more fully satisfactory, but also to be applicable to many mechanical designs of manually-operated motion chairs.

SUMMARY OF THE INVENTION

The front end of each side linkage of an ottoman thrusting/retracting pantograph linkage system for a motion chair is provided by a link, pivotally mounted to respective front end links at two vertically spaced sites. For each side, an ottoman mounting bracket is provided, having a generally vertical-plane flange and a transverse flange. The ottoman is secured to the two transverse flanges, and the vertical-plane flange, which extends below the transverse flange, is pivotally secured near its lower end to a corresponding lower end site on the pantograph front end links. The vertical-plane flanges of the ottoman-mounting brackets lie outboard of and in planes parallel to those of the respective front end links. A tension coil spring is provided at each side for tending to keep the ottoman positioned across the front edges of the front end links. But if, while the mechanism is being operated in a closing sense, the upper, rear edge of the ottoman encounters unusual resistance typical of someone or something being in the space through which the ottoman must move to fully retract, the ottoman will tiltingly release, against tensioning of the springs, permitting whatever is lodged, especially if it is animate, the opportunity and facility to escape, whereupon the springs will restore the ottoman to its normal disposition. By preference a stop is provided to limit tilting of the ottoman to about 90 degrees, in order to avoid damage to the springs which could occur were the ottoman to be intentionally tilted by a chair user's feet, e.g. so the user, while having the ottoman extended, could rest his or her feet against what, normally, is the backside of the ottoman.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION

Figure 1:
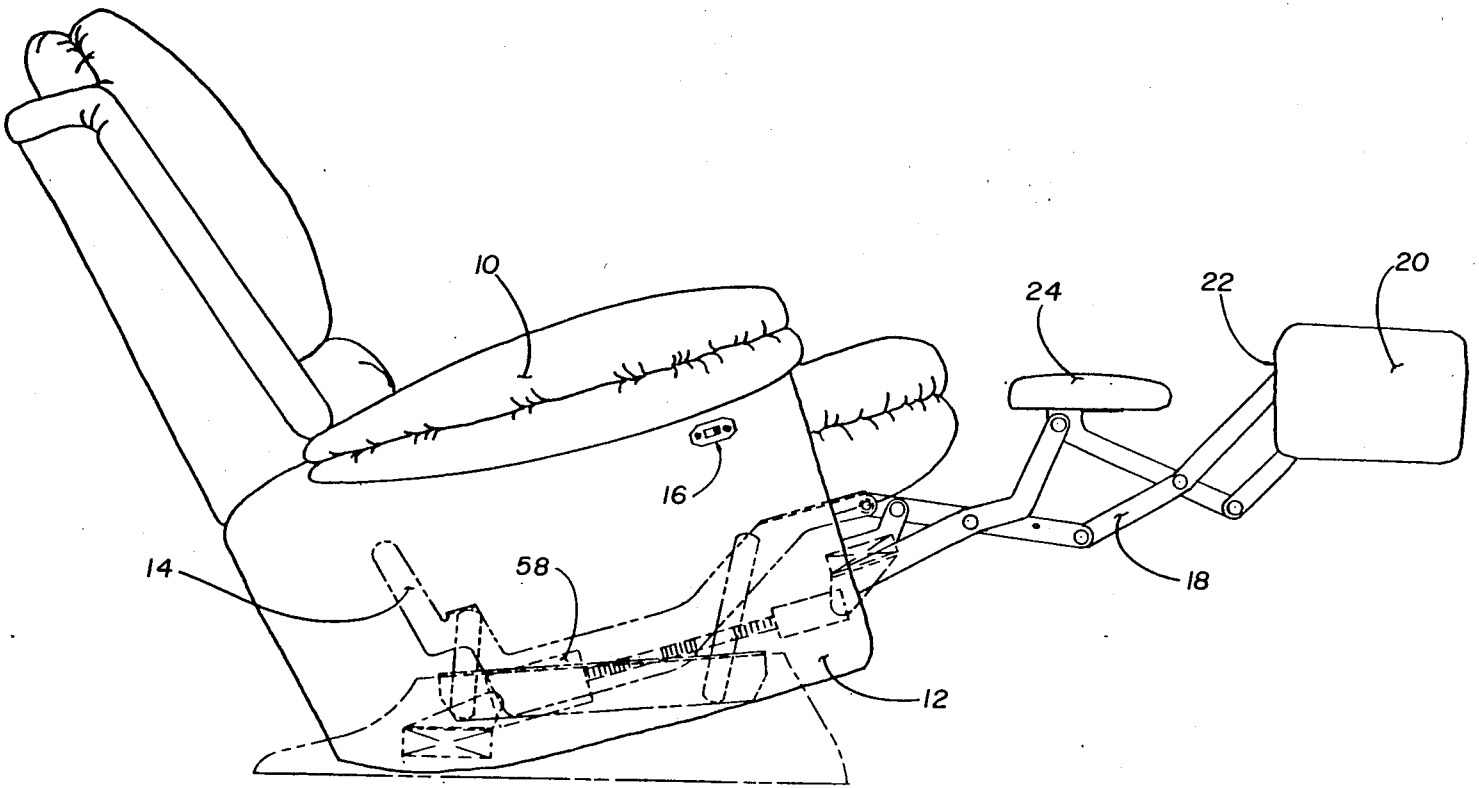
FIG. 1 is a small-scale perspective view of an electrically-operated motion chair having an ottoman and a sub-ottoman, the chair being shown with its ottoman in a fully raised and thrust condition. Although not especially apparent in this view, this motion chair is provided with the resiliently-releasing ottoman structure embodying the principles of the present invention.
Figure 2:
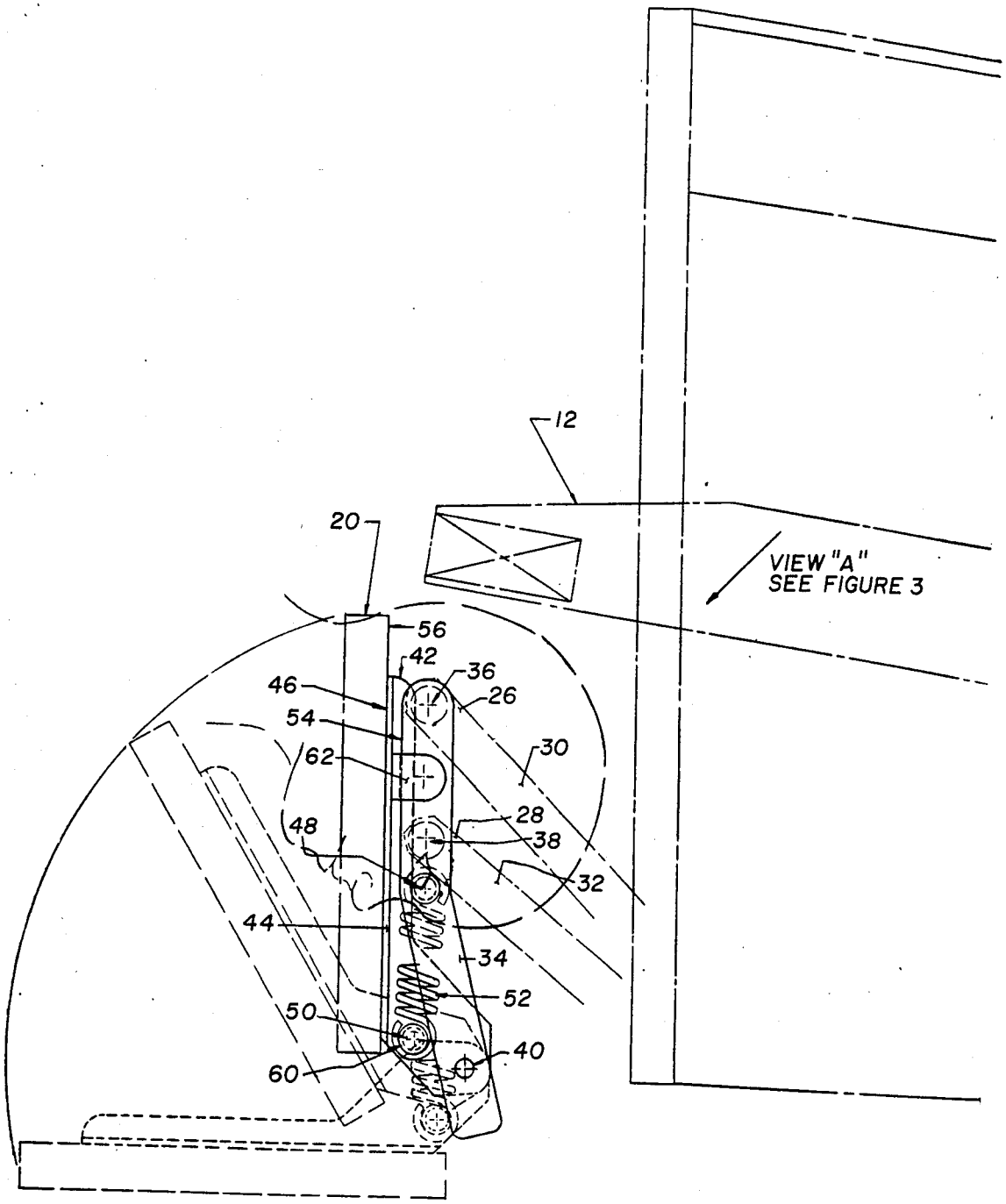
FIG. 2 is an enlarged scale fragmentary side elevational view of the chair of FIG. 1, with upholstery omitted and some structure indicated schematically in order to emphasize details of the novel ottoman-mounting structure. The normal position of the mechanism and ottoman as the ottoman is almost fully retracted is indicated in full lines in this figure. The two sets of phantom lines of the same structure which also are shown in this figure indicate how the novel mechanism permits the ottoman to become progressively resiliently biased away from the usual position, should a person or article (who or which is not supposed to be there) occupy the envelope of space through which the ottoman would normally move while being retracted.
Figure 3:
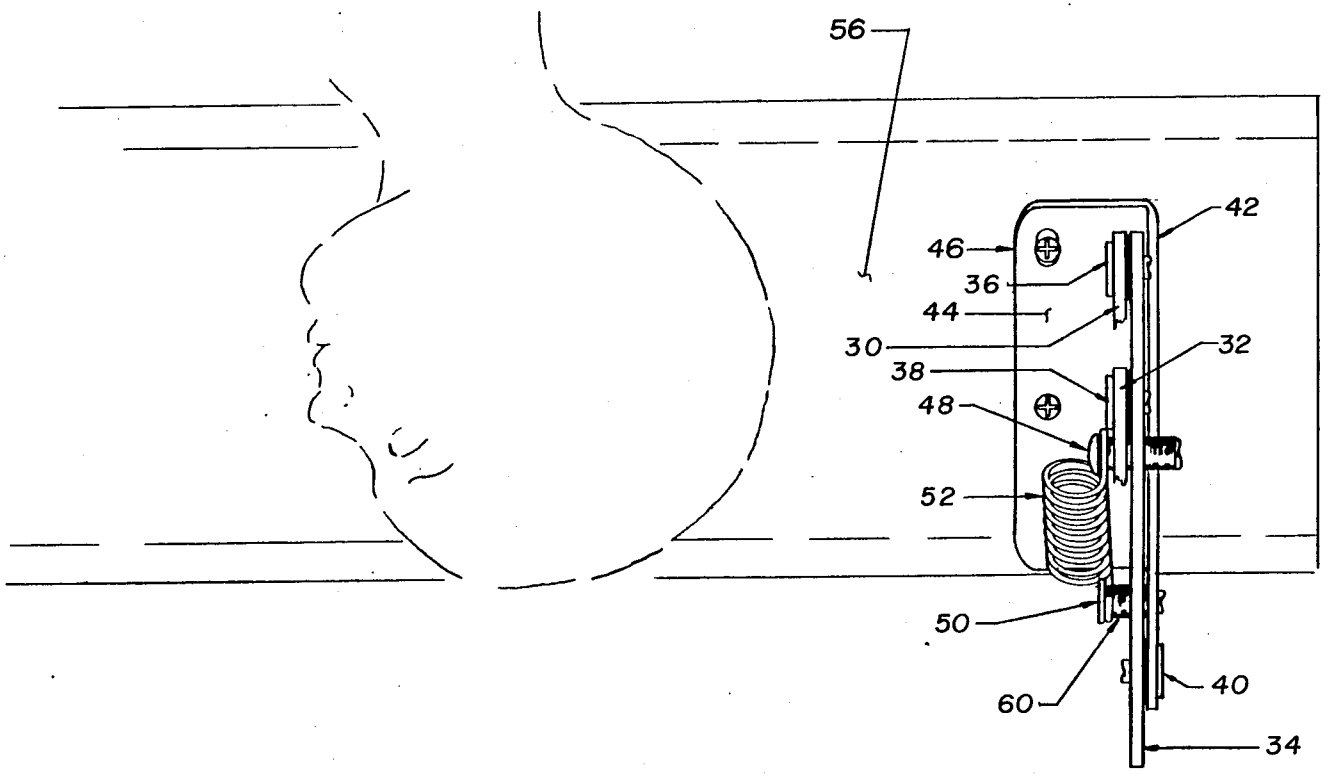
FIG. 3 is a fragmentary perspective view of the structure shown in FIG. 2, looking in the direction of the arrow A shown on FIG. 2, looking at the side linkage which is on the right (from the viewpoint of a person sitting in the chair, which would be the left side from the perspective of the child indicated by phantom lines in FIG. 2).

The drawings show a typical motion chair 10, especially but not essentially one having its upholstered seat frame 12 mounted to a base by an ottoman thrusting/retracting mechanism 14 (which could also be one constructed and arranged for reclining the chair backrest relative to the chair seat/arm frame and/or for inclining an inner upholstered seat frame relative to an outer, stationary frame), that is motorized, so that manual actuation of the conveniently located switch 16 will serve to extend and retract the pantograph linkage systems 18 of the respective side linkages of the mechanism 14, e.g. by an electric motor-type linear actuator 58 e.g. mounted between a cross-member of the mechanism 14 and a cross member of the base.

In general, to the extent that the drawings show only one of the side linkages of the chair, it should be understood, that, as is conventional, the chair 10 could be expected to have left and right side linkages which are mirror images of one another, located near opposite sides of the chair frame and interconnected by appropriate transverse members, the sole major exception being whatever structure is provided on one of the side linkages an/or on one of the cross members for manually or electrically operating the linkages e.g. for thrusting and retracting the footrest.

As shown, an ottoman 20 is provided at the front ends of the pantograph linkage systems 18 of the mechanism 14, but, in accordance with the principles of the present invention it is mounted to these linkage systems in an unusual way.

By preference, something is provided to largely occupy the space between the extended pantograph linkage systems, the rear edge 22 of the raised and thrust ottoman 20 and the front of the chair just below the seat cushion. The purpose of largely occupying this space is to prevent or reduce the likelihood that a child, cat or other extraneous object could become lodged in this space, especially an animate one that could be frightened or injured as the pantograph linkage systems were operated in a sense to lower, retract and stow the ottoman. One way of largely occupying this region is to hang a curtain of upholstery material (not shown) in a catenary between the rear edge of the ottoman and the front of the chair, just below the seat cushion. Another way, is to mount a sub-ottoman 24 between corresponding intermediate links of the pantograph linkage systems. This sub-ottoman preferably is sized so that neither the space between it and the main ottoman, nor the space between it and the front of the chair is ever large enough to permit a child to interpolate its head into that space.

A purpose of the special mounting for the main ottoman in accordance with principles of the present invention is to attempt to reduce the chances that should a lodgement occur in this space, or nevertheless occur in the space between the main ottoman and the sub-ottoman, the lodged creature will be able more easily to withdraw without significant injury, or even if inanimate or otherwise unable or unwilling to withdraw will not be placed in a garroting grip between the closing ottoman and the sub-ottoman or chair front.

According to principles of the present invention, instead of an ottoman mounting flange being directly pivotally mounted to the front ends 26, 28 of the respective bars 30, 32 of the respective pantograph linkage systems 18 of the mechanism 14, a connecting link 34 is pivotally mounted there, e.g. by respective transverse, horizontal axis pivot joints 36, 38. The links 34 may each be simple, flat links oriented in vertical planes. As shown, each link 34 extends a substantial distance below its lower pivot joint 36. Each link 34 is shown provided near the lower end thereof with a transverse, horizontal axis pivot joint 40 by which it is connected with the closely-outboard vertical plane flange 42 of an ottoman mounting bracket 44. The latter also has a transverse flange 46, which preferably is bent at right angles to the respective flange 42, and projects inboards.

Transverse, horizontal axis pins 48, 50 are provided which cantilever inboards from respective inboard faces of the respective links 34 and ottoman mounting bracket flanges 42. A tension coil spring 52 is mounted between each of these pairs of pins 48, 50 for the purpose of normally maintaining the ottoman with its mounting brackets 44, so snuggly against front edges 54 of the links 34, that from the standpoint of appearance, it would be difficult or impossible for the casual observer to notice that the ottoman is not conventionally mounted to the pantograph linkage systems.

However, in use, should someone or something become lodged in the space between the rear of the retracting ottoman and the sub-ottoman or chair front, the mounting structure provided in accordance with the principles of the present invention will permit the ottoman to tiltingly resiliently flex away from its usual position until the obstruction withdraws or is cleared.

Further, although the present inventor certainly prefers so designing, constructing and installing the electrical operation mechanism that the travel-to-close obtainable from the electric motor is sufficient to fully retract and stow the ottoman without causing damage by attempting to pull the ottoman further towards the chair, the ottoman mounting structure provided in accordance with principles of the present invention will accomodate a small amount of attempted overretraction. And, unlike the apparatus of the prior art, this accomodation is accomplished by resilient tilting displacemnt of the ottoman, with its brackets, so that the usual position is disturbed as little as necessary, and is automatically re-achieved as the motor is next operated to again thrust the ottoman.

Further, although it is by far the most prevalent practice to leave the usually unseen underside 56 of the ottoman plain and neither padded nor attractively upholstered, it would be within the contemplation of the invention to attractively upholster that underside. Then, should a user while sitting in the chair with the ottoman raised discover with his or her feet that the ottoman can be rotated forwards, against the restorative force provided by the springs 52, he or she will be provided with a finished, alternate, perhaps more preferably-oriented surface 56 on which to rest his or her feet. Yet, when he or she wishes to return to a more conventional use of the ottoman, or to retract the ottoman, upon momentarily lifting his or her feet enough to take the added tension off the springs 52, the springs 52 will automatically rotate the footrest back to its usual position.

In order to prevent a chair-user from absently flipping the ottoman so far around (e.g. by rotating it through more than a half-circle) so that it stays in an awkward position and possibly damages the springs 52 by bending them, a limit stop may be provided. Conveniently, the limit stop may take the form of arranging a lower end portion 60 of each connecting link to engage under the pin to which the lower end of the respective spring 52 is attached, e.g. so as to limit the possible rotation of the ottoman to about ninety degrees forwards and down from its normal position.

A pair of bumpers 62, e.g. of rubber or resilient plastic or the like may be provided between the back of the ottoman or its mounting flanges and the links 34 for preventing undue noise as the springs 52 pull the ottoman back to its usual position from a resiliently biased lodgement-releasing or lodgement-accomodating position.

The term 'chair', has been used herein in a generic sense, inasmuch as the principles of the invention can be used on any similar unit of seating furniture, regardless of whether it is free-standing, or incorporated in some larger item, such as a loveseat or couch.

It should now be apparent that the resiliently releasing ottoman for motion chair as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. Apparatus for providing a motion chair with a resiliently releasing capability for a transversally elongated ottoman which is movable between a raised, thrust position in which the ottoman is generally horizontal, and a retracted, stowed position in which the ottoman normally is generally vertical, for which purpose the ottoman is mounted to a seat frame of the motion chair by a mechanism which includes left and right side linkages, each of which, towards its front, has a set of pantograph links including an upper pantograph link having a front end and a lower pantograph link having a front end, said apparatus comprising:

a generally vertical plane front end link for each side linkage, each of these front end links being elongated in a direction which is adapted to be generally vertically-oriented when the ottoman is in its retracted, stowed position;

said front end links, with respect to such vertical orientation, each having:

an upper transversally extending horizontal axis pivot means for pivotally connecting with said front end of said upper pantograph link of the respective said side linkage, a lower transversally extending horizontal axis pivot means for pivotally connecting with said front end of said lower pantograph link of the respective said side linkage, and adjacent but displaced from said lower transversally extending horizontal axis pivot means, a further transversally extending horizontal axis pivot means;

a pair of ottoman mounting brackets, each having a vertical plane flange, each of these brackets being elongated in a direction which is adapted to be generally vertically oriented when the ottoman is in its retracted, stowed position;

securement means on said ottoman mounting brackets adapted for mounting said ottoman thereto;

each said vertical plane flange, effectively below said securement means, relative to said vertical direction of orientation of said vertical plane flanges, being pivotally connected to a respective said front end link by a respective said further transversally extending horizontal axis pivot means; and resilient means tending to maintain each said vertical plane flange aligned with the respective said front end link as to said direction of elongation of each, but permitting the respective vertical plane flange to pivot forwardly about the respective said further transversally extending horizontal axis pivot means against a restoration force provided by said resilient means, so that the ottoman may pivot forward to accomodate and release an obstruction to its being brought to its retracted, stowed position, then be automatically pivoted rearward by the resilient means when the obstruction has been cleared.

2. The apparatus of claim 1, wherein:

said further transversally extending horizontal axis pivot means is located on the respective front end link below the respective said lower transversally extending horizontal axis pivot means.

3. The apparatus of claim 2, wherein:

said resilient means comprises a pair of tension coil springs each connected between a respective said front end link and the respective said ottoman mounting bracket.

4. The apparatus of claim 3, wherein:

each said vertical plane flange of each said ottoman mounting bracket is disposed in a plane outboard of and closely parallel to the respective said front end link; and each tension coil spring extends between mounting means provided on the respective said front end link intermediate the respective said lower and further transversally extending horizontal axis pivot means and mounting means provided on the respective said vertical plane flange forwardly of and adjacent to said further transversally extending horizontal axis pivot means.

5. The apparatus of claim 4, wherein:

each said ottoman mounting bracket includes a transverse flange extending inboards from a front edge of the respective said vertical plane flange; and said securement means is provided on said transverse flanges.

6. The apparatus of claim 1, wherein:

each said ottoman mounting bracket includes a transverse flange extending inboards from a front edge of the respective said vertical plane flange; and said securement means is provided on said transverse flanges.

7. A motion chair having a resiliently releasing capability for an ottoman thereof, said motion chair comprising:

a seat frame;

a transversally elongated ottoman;

a mechanism mounting said ottoman to said seat frame for movement between a raised, thrust position in which the ottoman is generally horizontal, and a retracted, stowed position in which the ottoman normally is generally vertical;

said mechanism including left and right side linkages, each of which, towards its front, has a set of pantograph links including an upper pantograph link having a front end and a lower pantograph link having a front end;

a generally vertical plane front end link for each side linkage, each of these front end links being elongated in a direction which is adapted to be generally vertically-oriented when the ottoman is in its retracted, stowed position;

said front end links, with respect to such vertical orientation, each having:

an upper transversally extending horizontal axis pivot means pivotally connecting with said front end of said upper pantograph link of the respective said side linkage, a lower transversally extending horizontal axis pivot means pivotally connecting with said front end of said lower pantograph link of the respective said side linkage, and adjacent but displaced from said lower transversally extending horizontal axis pivot means, a further transversally extending horizontal axis pivot means;

a pair of ottoman mounting brackets, each having a vertical plane flange, each of these brackets being elongated in a direction which is adapted to be generally vertically oriented when the ottoman is in its retracted, stowed position;

securement means on said ottoman mounting brackets mounting said ottoman thereto;

each said vertical plane flange, effectively below said securement means, relative to said vertical direction of orientation of said vertical plane flanges, being pivotally connected to a respective said front end link by a respective said further transversally extending horizontal axis pivot means; and resilient means tending to maintain each said vertical plane flange aligned with the respective said front end link as to said direction of elongation of each, but permitting the respective vertical plane flange to pivot forwardly about the respective said further transversally extending horizontal axis pivot means against a restoration force provided by said resilient means, so that the ottoman may pivot forward to accomodate and release an obstruction to its being brought to its retracted, stowed position, then be automatically pivoted rearward by the resilient means when the obstruction has been cleared.

8. The motion chair of claim 7, wherein:

said further transversally extending horizontal axis pivot means is located on the respective front end link below the respective said lower transversally extending horizontal axis pivot means.

9. The motion chair of claim 8, wherein:

said resilient means comprises a pair of tension coil springs each connected between a respective said front end link and the respective said ottoman mounting bracket.

10. The motion chair of claim 9, wherein:

each said vertical plane flange of each said ottoman mounting bracket is disposed in a plane outboard of and closely parallel to the respective said front end link; and each tension coil spring extends between mounting means provided on the respective said front end link intermediate the respective said lower and further transversally extending horizontal axis pivot means and mounting means provided on the respective said vertical plane flange forwardly of and adjacent to said further transversally extending horizontal axis pivot means.

11. The motion chair of claim 10, wherein:

each said ottoman mounting bracket includes a transverse flange extending inboards from a front edge of the respective said vertical plane flange; and said securement means is provided on said transverse flanges.

12. The motion chair of claim 7, wherein:

each said ottoman mounting bracket includes a transverse flange extending inboards from a front edge of the respective said vertical plane flange; and said securement means is provided on said transverse flanges.

13. The motion chair of claim 7, wherein:

said chair includes frame means having a relatively stationary element;

a longitudinally extensible/retractible element mounted between said relatively stationary element and said mechanism for extending and retracting said pantograph links for moving said ottoman between said retracted, stowed and raised, thrust positions thereof.

14. The motion chair of claim 13, wherein:

said longitudinally extensible/retractible element comprises an electrically operated lead screw means.

15. The motion chair of claim 13, further including: transversally elongated sub-ottoman means mounted to said pantograph links of said left and right side linkages rearwardly of said ottoman.

16. The motion chair of claim 7, further including: transversally elongated sub-ottoman means mounted to said pantograph links of said left and right side linkages rearwardly of said ottoman.

* * * * *